United States Patent [19]

DeSpain et al.

[11] Patent Number: 4,916,865

[45] Date of Patent: Apr. 17, 1990

[54] APPARATUS FOR SURFACE TREATING A WORKPIECE

[75] Inventors: James R. DeSpain, Prospect; Michael E. Burke, Louisville, both of Ky.

[73] Assignee: Carrier Vibrating Equipment, Inc., Louisville, Ky.

[21] Appl. No.: 125,613

[22] Filed: Nov. 25, 1987

Related U.S. Application Data

[62] Division of Ser. No. 720,135, Apr. 5, 1985.

[51] Int. Cl.[4] ..... B24B 31/00

[52] U.S. Cl. ..... 51/7; 51/17

[58] Field of Search ..... 51/7, 17, 6, 163.1, 51/16, 317–318, 316

[56] References Cited

U.S. PATENT DOCUMENTS

| | | | |
|---|---|---|---|
| 1,736,846 | 11/1929 | Cole et al. | 51/316 |
| 3,336,701 | 8/1967 | Moore | 51/7 |
| 3,382,621 | 5/1968 | Kellard | 51/7 |
| 3,783,560 | 1/1974 | Casapopol et al. | 51/5 |
| 4,499,692 | 2/1985 | Balz | 51/163.1 |
| 4,586,293 | 5/1986 | DeSpain et al. | 51/7 |

FOREIGN PATENT DOCUMENTS

| | | | |
|---|---|---|---|
| 0580094 | 11/1977 | U.S.S.R. | 51/7 |

*Primary Examiner*—Robert Rose
*Attorney, Agent, or Firm*—Jon C. Winger

[57] ABSTRACT

A method for surface treating a continuous flow of workpieces includes the steps of fluidizing a stationary bed of surface treating media, aggitating the fluidized bed of surface treating media to create a scrubbing action to the surface treating media, submerging the workpieces to be treated in the stationary, fluidized, aggitated media bed subjecting the workpieces to the scrubbing action of the media, holding the submerged workpiece stationary within the fluidized, aggitated bed of surface treating media, releasing the hold on the workpiece, and removing the workpiece from the bed of surface treating media. Further, an apparatus for surface treating workpieces which includes a reservoir for containing a bed or pool of surface treating media, a vibration generating device for imparting a reciprocating force to the reservoir, having at least a vertical force vector, to the reservoir and, therefore, to the surface treating media contained in the reservoir, means for passing a gas generally upwardly through the reservoir to fluidize the bed of surface treating media contained in the reservoir, and clamping device for clamping the workpiece in a stationary position in the reservoir.

20 Claims, 2 Drawing Sheets

APPARATUS FOR SURFACE TREATING A WORKPIECE

BACKGROUND OF THE INVENTION

CROSS-REFERENCE TO RELATED APPLICATION

This is a Division of application ser. No. 06/720,135, Filed Apr. 5, 1985.

FIELD OF THE INVENTION

The present invention relates to a method and apparatus for surface treating the surface of a workpiece, more particularly, to a method and apparatus wherein the workpieces to be surface treated are selectively intermittently moved through a bed of aggitated surface treating media.

DISCUSSION OF THE PRIOR ART

Various processes and apparatus are known to the art for surface treating workpieces. Examples are shown in the following U.S. Patents.

U.S. Pat. No. 2,815,609 issued on Dec. 20, 1957 shows an apparatus for deburring and polishing workpieces including a pan which holds deburring material such as steel balls or stones. The pan is mounted in a stationary frame for vertical reciprocating movement by means of sprockets and chains supported on the frame. The apparatus includes a shaft which is mounted to the frame over the pan and is moved in a reciprocating motion along its longitudinal axis by means of an eccentric. The workpiece to be deburred is clamped to the reciprocating shaft to depend therefrom, and the pan is raised so that the workpiece is submerged in the deburring material. The shaft is then reciprocated to move the workpiece back and forth through the deburring material. After a sufficient time, the pan is lowered and the workpiece is removed from the deburring material, and the deburred workpiece is removed from.

U.S. Pat. No. 2,918,926 issued on Dec. 29, 1959 shows a washing and degreasing apparatus which includes a large tank for holding a suitable liquid solution in the tank. The parts basket has one open end, and is mounted on springs for vibrator and oscillatory motion. A vibration generating device which includes an electric motor is connected to the parts basket by means of belt to impart a vibratory motion to the basket. In addition, a sloped endless conveyor is located within the tank so that a portion of the conveyor lies below the open end of the parts basket to receive the parts from the basket and convey the parts out of the tank. Parts to be cleaned are deposit in the basket near the end thereof opposite the open basket end so that they are immersed in the cleaning solution. The basket is then caused to vibrate so that the parts therein will be moved toward the open basket end and be discharged onto the endless conveyor for removal from the tank.

U.S. Pat. No. 3,045,397 issued on July 24, 1962 shows an apparatus for surface treating parts which includes a support frame mounted on springs and an electric motor connected to the support frame through a belt system for imparting a vibratory action to the support frame. The apparatus further includes a plurality of parts receiving vats rigidly mounted to the support frame. The parts to be treated as well as liquid treating agent are placed in the vats, and the frame is vibrated.

U.S. Pat. No. 3,128,577 issued on April 14, 1964 shows an apparatus for deburring articles of considerable length which includes a tank containing abrasive material. Vibrator devices are attached to the outer side of the floor of the tank to vibrate the abrasive material in the tank. The opposite end walls of the tank have aligned apertures for accommodating the longitudinal movement of an elongated article to be deburred through the tank. The apertures have seals to prevent abrasive material from leaking out of the tank. Powered article feed rollers are located outside the tank at one end wall. The elongated article to be deburred is inserted longitudinally through the apertures in the tank end walls and is engaged by the feed rollers. The feed rollers move the elongated article through the tank wherein it is subjected to the vibrating abrasive material and is deburred thereby.

U.S. Pat. No. 3,148,483 issued on Sep. 15, 1964 shows a machine for the surface treatment of an article by the reaction of media in vibratory movement which includes a rigid base with a horizontal table resiliently supported on the base by coil springs and a trough containing particulate treating material is secured to the table. Vibratory movement is imparted to the table, and therefore to the trough, by means of an eccentric drive arrangement located in the base below the table. The elongated trough has an upstream end wall, spaced apart side walls, a concave floor, and is open at the downstream end A perforated platform is located at the open downstream or outlet end of the trough to separate particulate media exiting the trough from the treated articles also exiting the trough. The separated media is returned to the upstream end of the trough through an inlet chute for reuse in the treatment of further articles placed in the trough.

U.S. Pat. No. 3,336,701 issued on Aug. 22, 1967 shows a vibratory finishing apparatus for deburring articles including an elongated, downwardly inclined container box containing an abrasive particulate material. The elongated, sloped container box is suspended on air cushions on fixed legs. Vibration is imparted to the container box by means of driven shafts and eccentric weights located beneath the container box. Articles to be finished are loaded into the container box by a chute located at the elevated container end. The lower end of the container box includes a lip over which finished articles and particulate treating material overflow from the container box. A screen arrangement is positioned beneath the container lip outside the container box for separating finished articles from the abrasive particulate material. The particulate material passes through the screen onto a recycling conveyor which returns the particulate material back to the container box for reuse.

U.S. Pat. No. 4,258,505 issued on May 31, 1981 shows another apparatus for cleaning a workpiece with abrasive particulate material which includes a closed vessel. A grate is located within the vessel above the vessel floor. A bed of abrasive material is located above and supported on the grate, and the volume beneath the grate forms a plenum chamber. Compressed air is introduced into the plenum chamber and passes upwardly through the grate to maintain the abrasive material in a fluid and agitated state. The two end walls of the vessel are formed with openings through which a continuous elongated workpiece is moved through the bed of abrasive material. In addition, air conduits are located through the bed of abrasive material next to the path of the elongated workpiece passing through the abrasive material bed. These air conduits have nozzles oriented to direct compressed air streams against the surface of the workpiece moving through the abrasive material bed. The air issuing from these nozzles pick up particles from the fluidized bed and propels the abrasive particles at high velocity against the surface of the workpiece. A mixture of air and abrasive material rising from the abrasive bed is removed from the vessal through an exhaust duct to a separator device. The separator device separates particulate material from the air. The separated particulate material is returned to the vessel for reuse, and the separated air is exhausted to the atmosphere.

SUMMARY OF THE INVENTION

The present invention provides a method and an apparatus for the selected intermittent flow of workpieces through a bed of surface treating media.

The present invention further provides a method and apparatus of the class described wherein the exterior surface and any open internal voids of the workpiece are concurrently surface treated.

More particular, the present invention in one embodiment provides a method of surface treating workpieces comprising the steps of: fluidizing a substantially stationarily positioned bed of a surface treating media; aggitating the fluidized bed of surface treating media; submerging the workpiece in the fluidized, aggitated bed of surface treating media, selectively holding the submerged workpiece stationary within the fluidized, aggitated bed of surface treating media; releasing the hold of the workpiece; and removing the workpiece from the bed of surface treating media.

The present invention further provides an apparatus for surface treating workpieces, comprising: means defining a reservoir for containing a bed of surface treatment media; vibrating means for imparting a vibratory force to the reservoir defining means; means for passing a gas generally upwardly through the reservoir defining means to fluidize the bed of surface treatment media contained therein; and means for selectively clamping the workpieces in a stationary position within the reservoir defining means.

BRIEF DESCRIPTION OF THE DRAWING

The various features and advantages of the present invention will become even more clear upon reference to the following discussion in conjunction with the accompanying drawings wherein like numerals refer to like parts through an in which.

DETAILED DESCRIPTION OF THE PREFERRED EMBODIMENT

Figure 1:
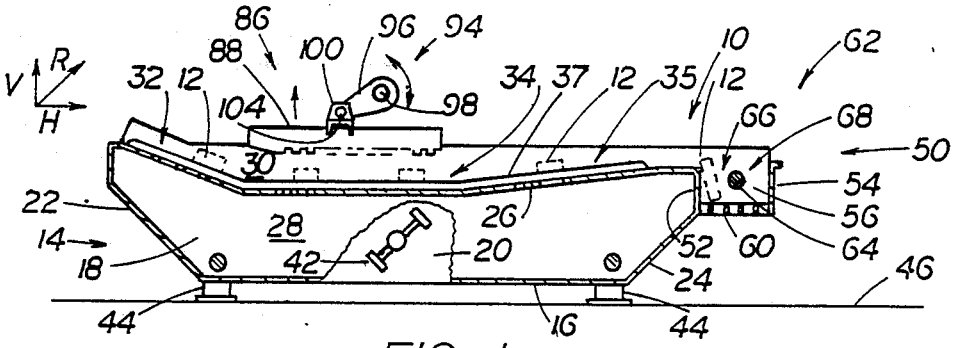
FIG. 1 is a side view of one advantageous embodiment of the present invention with portions broken out to more clearly show internal features; with a clamping device in the workpiece release position.
Figure 2:
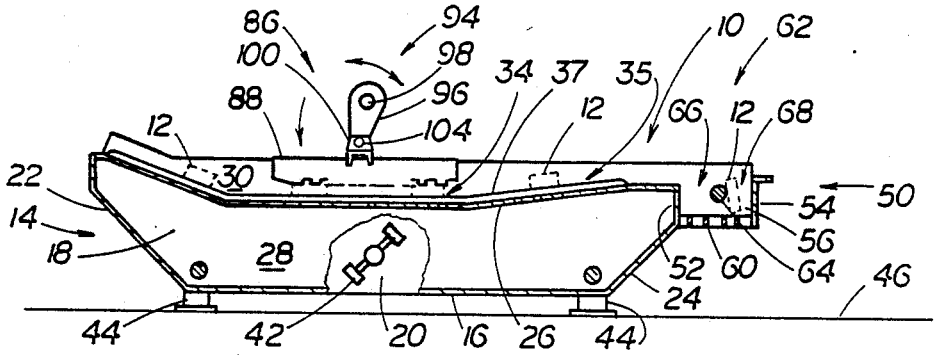
FIG. 2 is a side view of the embodiment of FIG. 1 with the clamping device in the workpiece clamping or holding position.

With reference to FIGS. 1 and 2, there is shown a longitudinal cross-sectional view of an apparatus of the present invention, generally denoted as the numeral 10, for surface treating workpieces 12 shown in broken lines. The workpieces to be surface treated can be virtually any article of manufacture. Examples of the types of surface treatment for which the apparatus 10 can be used include, but are not limited to, deburring, polishing, burnishing and cleaning of the workpiece.

The apparatus 10 includes an elongated housing, generally denoted as the numeral 14, which comprises a floor 16, two spaced apart generally parallel side walls 18 and 20, and two spaced apart generally parallel end walls 22 and 24. In addition , an elongated foraminous top deck 26 coextensive with the length and width of the housing 14 is located in the housing below the top edges of the housing walls 18, 20, 22, 24 and above the housing floor 16. The foraminous deck 26 cooperates with the housing floor 16 and the portion of the housing walls below the deck 26 to define a fluidizing gas plenum 28. Further, the foraminous deck 26 cooperates with the portion of the housing walls above the deck 26 to define a surface treatment media reservoir 30. As can be best seen in FIGS. 1 and 2, the foraminous deck 26 includes a generally downwardly declined upstream length 32 slanting downwardly generally from the top edge of the upstream housing end wall 22 a predetermined distance below the top edges of the housing side walls 18 and 20, a generally horizontal deck length 34 extending from the lower end of the declined foraminous deck length 32 longitudinally of the housing 14 in a direction toward the downstream housing end wall 24 and terminating at a predetermined location short of the downstream housing end wall 24, and an upwardly inclined deck length 35 mating with the terminal end of the horizontal deck length 34 and extending upwardly therefrom to substantially the top edge of the downstream housing end wall 24. The horizontal deck length 34 is preferably located below the top edges of the housing walls by a distance at least equal to the largest dimension of the workpiece 12 to be surface treated. The length of the horizontal deck length 34 will be determined by the length of time required to complete the surface treatment of the workpiece. A plurality of small, parallel, spaced apart workpiece support rails 37 are located on the top surface of the foraminous deck 26 and extend longitudinally of the surface treating reservoir 30. The workpieces ride on the support rails 37 as the workpieces move through the surface treating reservoir 30. The support rails 37 hold the workpieces above the top surface of the foraminous deck 26. The support rails 37 can be fabricated of a material which has a lower coefficient of friction than does the foraminous deck 26. Thus, the support rails prevent wear to the foraminous deck 26, make it easier for the workpieces to move longitudinally of the treatment reservoir 30 and Provide a space between the bottom side of the workpiece and foraminous deck 26 in which surface treating media may reside so that all surfaces of the workpiece is contacted by surface treating media. The housing 14 also includes fluidizing gas inlet ports 36 formed through a housing side wall, for example side wall 20, to communicate with the plenum 28. Fluidizing gas can be introduced through the gas inlet ports 36 by virtually any means, for example, by a fan or blower which forces air through appropriate conduits interconnecting the blower to the inlet ports 36.

The apparatus 10 further includes vibrating means, generally denoted as the numeral 42, for causing the housing 14 to vibrate. The vibrating means can be virtually any known or otherwise convenient device such as, for example, an eccentric drive arrangement or rotating unbalanced mass device. The critical feature of the vibrating means 42, of whatever type used, is that it imparts to the housing 14 a horizontal component vector (denoted by the arrow "H" in FIG. 1) in the direction generally from the upstream housing end wall 22 toward the downstream housing end wall 24, and a generally vertical component vector (denoted by the arrow "V" in FIG. 1). That is to say, the resultant of the vibration vector imparted to the housing should be at an acute angle to the horizontal (denoted by the arrow 'R' in FIG. 1).

This housing 14 is preferably mounted on vibration isolation damper means 44 to isolate the vibrating apparatus 10 from its environment. Various isolation damper means are well known and include, but are not limited to gas-filled bags, liquid-filled devices, resilient pandas and leaf springs. As shown in FIG. 1, the apparatus 10 is isolated from the floor 46 of a facility in which it is placed by vibration dampers in the form of coil springs.

The surface treating media reservoir 30 is filled with an appropriate workpiece surface treating media. It is presently contemplated that the surface treating media will be particulate material, or a combination of particulate material and liquid. The exact nature of the surface treating media will, of course, depend upon the type of surface treatment to be carried out, and upon the material of which the workpiece 12 are fabricated. However, by way of example, the particulate material could be sand, stones, steel shot, and the liquid could be, for example, a solvent such as water.

With continued reference to FIGS. 1 and 2, the apparatus 10 further includes workpiece receiving means, generally denoted as the numeral 50, located outside the housing 14 at the downstream housing end wall 24 and open to the reservoir 30. The workpiece receiving means 50 is shown as an open topped enclosure having a front wall 52, a rear wall 54, side walls 56 and 58, a foraminous floor 60, and an open top 62 defined by the top edges of the front rear and side walls. The workpiece receiving enclosure 50 is affixed to the downstream housing end wall 24 with the top edge of the enclosure front wall 52 at approximately the elevation of the elevated end of the inclined foraminous deck length 35. Because the workpiece receiving enclosure 50 is attached to the housing 14, the enclosure 50 is also subjected to the vibratory forces generated by the vibrating means 42. Inside the workpiece receiving enclosure 50 are workpiece restraining means 64. As shown, the workpiece restraining means comprises at least one horizontal bar located above the foraminous enclosure floor 60, spanning the distance between the enclosure side walls 56 and 58, and about midway between the front enclosure wall 52 and rear enclosure wall 54, thereby dividing the interior of the enclosure into two workpiece receiving sections 66 and 68.

Figure 5:
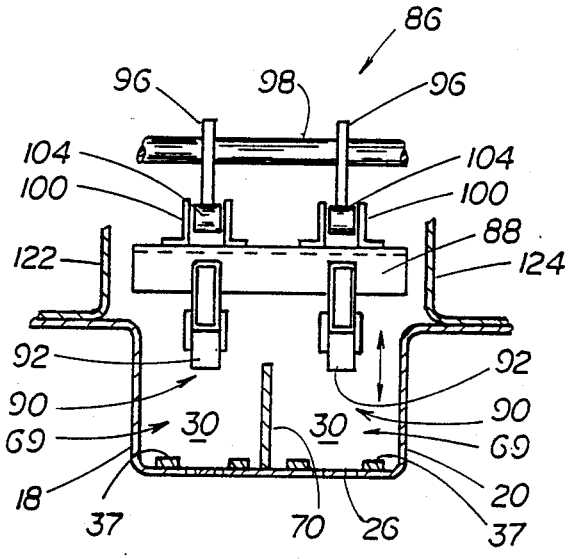
FIG. 5 is a transverse cross-sectional view taken in the direction of arrows 5—5 in FIG. 4.

As can be best seen in FIG. 5, the housing 14 is shown as having the surface treating reservoir 30 divided into two identical side-by-side longitudinally extending workpiece lanes 69 by a partition 70 extending longitudinally in the treating reservoir 30 and along the longitudinal centerline of the treating reservoir 30. This arrangement provides for the movement of two rows of workpieces concurrently through the reservoir 30. The width of the reservoir 30 can be sized to have a single lane 69 to process only one row of workpieces through the reservoir or, for that matter, any number of lanes 69 to accommodate two or more rows of workpieces as the volume of a manufacturing process may require. For the reason that the number of lanes 69 into which the reservoir 30 is divided does not constitute a part of the invention, for the sake of brevity, the following discussion will speak in the singular as the reservoir 30 included a single lane. However, it should be understood that the reservoir 30 can be divided into any number of lanes 69 without departing from the features of the invention.

With reference to FIGS. 1, 2, 4 and 5, the apparatus 10 further includes workpiece clamping means, generally denoted as the numeral 86, for selectively clamping the workpieces in a stationary position in the reservoir 30 of the housing 14. As shown, the clamping means 86 includes a generally horizontal plate 88 located over at least a portion of the horizontal length 34 of the foraminous deck 26. The lower side 90 of the horizontal plate 88 constitutes the workpiece contact side of the horizontal plate 88 and is fitted with resiliently deformable workpiece contact bumpers 92. The generally horizontal clamping plate 88 is mounted for movement in a generally horizontal plane between a raised or workpiece release position whereat the workpiece contact side 90 is spaced above the foraminous housing deck 26 by a distance somewhat greater than the thickness dimension of a workpiece when resting on the foraminous deck 26 (See FIG. 1), and a lowered or workpiece clamping or holding position whereat the workpiece contact side 90 is spaced above the foraminous housing deck 26 by a distance generally equal to and preferably somewhat less than the thickness dimension of a workpiece when resting on the foraminous deck 26 (See FIG. 2).

With continued reference to FIGS. 1, 2, 4 and 5, the workpiece clamping means 86 also includes workpiece clamping plate moving means, generally denoted by the numeral 94, for moving the clamping plate 88 between the workpiece release position and workpiece clamping position. As can be best seen in FIGS. 4 and 5, the clamping plate moving means 94 comprises a lever arm 96 pivotally attached at its distal end to the clamping plate 88 near the longitudinal center line of the clamping plate 88, and at its proximale end to a driven shaft 98 for rotation with the driven shaft 98.

Figure 6:
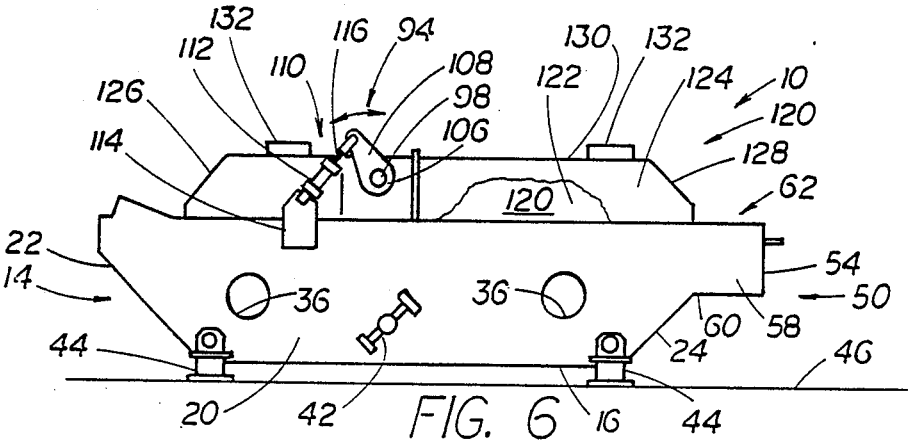
FIG. 6 is a side view of a further advantageous embodiment of the present invention with portions broken away to more clearly show internal features.
Figure 4:
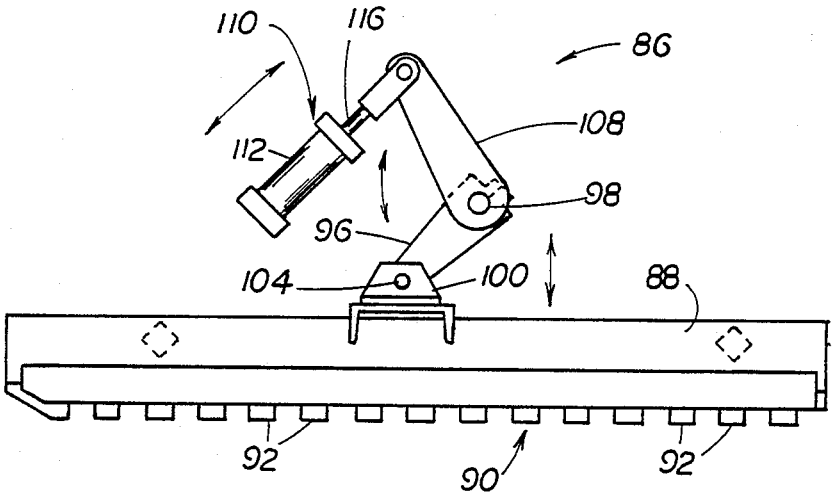
FIG. 4 is a side view of an advantageous embodiment of the clamping device of the present invention.

The pivot attachment of the distal end of the lever arm 96 to the clamping plate 88 can be accomplished in various ways. For example, as can be best seen in FIGS. 4 and 5, the pivotal attachment can include clevis bracket 100 attached to the top side of the clamping plate 88. The distal end of the lever arm 96 has an aperture 102 which aligns with the apertures in the clevis brackets 100. A pivot pin 104 fits through the aperture 102 in the distal end of the lever arm 96 and the aligned apertures in the clevis bracket 100. The driven shaft 98 is supported in journal bearings 106 mounted to the housing side walls 18 and 20 above the foraminous deck 26 (See FIG. 6). A driving lever arm 108 is attached at its proximal end to the driven shaft 98 so that the driven shaft 98 will rotate with the driving lever arm 108 as it is caused to move. As can be best seen in FIGS. 4 and 6, a hydraulic or pneumatic cylinder device 110 is used to actuate the driven shaft 98 through the lever arm 96 and driving lever arm 108, thus, causing the clamping Plate 88 to move between the clamping and unclamping or release positions. As can be best seen in FIGURES 4 and 6, the free end of the cylinder portion 112 of the cylinder device 110 is pivotally attached to a mounting bracket 112. The mounting bracket 112 is attached to the side walls 18 and 20 of the housing 14. The extending end of the piston rod 116 of the cylinder device 110 is pivotally attached to the distal end of the driving lever 108. Thus, as the cylinder device 110 is actuated to extend the piston rod 116, the extending piston rod 116 causes the driving lever arm 108 to pivot in a clockwise direction as seen in FIGS. 4 and 6. This clockwise rotation of the driving lever arm 108 in turn causes the driven shaft 98 to rotate in the same, i.e. clockwise direction in the journal bearings 106. Further, as the driven shaft 98 thus rotates, it causes the lever arm 96 to rotate in a clockwise rotation with the driven shaft 98. The clockwise flotation of the lever arm 96 causes the proximal end of the lever arm 96 to move in an arcuate path upwardly away from the foraminous deck 26 of the housing 14. Thus, the clamping plate 88 is caused to also move upwardly with the proximal end of the lever arm 96 to the raised or workpiece release position shown in FIG. 1. Similarly, as the cylinder device 110 is actuated to retract the piston rod 116, the retracting piston rod 116 causes the driving lever arm 108 to pivot in the other or counterclockwise direction as seen in FIGS. 4 and 6. This counterclockwise rotation of the driving lever arm 108 in turn causes the driven shaft 98 to rotate in the same, i.e., counterclockwise direction in the journal bearings 106. Further, as the driven shaft 98 thus rotates, it causes the lever arm 96 to rotate in a counterclockwise rotation with the driven shaft 98. The counterclockwise rotation of the lever arm 96 causes the proximal end of th arm 96 to move in an arcuate path downwardly toward the foraminous deck 26 of the housing 14. Thus, the clamping plate 88 is caused to move downwardly with the proximal end of the lever arm 96 to the lowered or workpiece clamping position shown in FIG. 2.

The pivotal attachment of the proximal end of the lever arm 96 to the clamping plate 88 provides a self-adjusting feature of the clamping plate 88 particularly when the clamping plate 88 in the lowered or clamping position and is used to concurrently clamp two or more workpieces spaced along the length of the horizontal section 34 of the foraminous deck 26. Thus, given the situation where the top side of a workpiece laying on the horizontal section 34 of the foraminous deck 26 may be higher than the top side of another workpiece also laying on the horizontal section 34 of the foraminous deck 26, due to for example manufacturing tolerances in the workpieces, the contact plate 88 can pivot about the pivot pins 104 such that the clamping contact bumpers 92 at the clamping side 90 of the contact plate 88 will contact the top sides of all of the workpieces. This feature of the mounting of the contact plate 88 to the lever arm 98 along with the resilient feature of the contact bumpers 92 provides for exerting a relatively uniform clamping force on the top side of the workpieces forcing the workpieces down against the horizontal section 34 of the foraminous plate 26.

The surface treating media reservoir 30 is filled with an appropriate workpiece surface treating media 48. It is presently contemplated that the surface treating media 48 will be particulate material, or a combination of particulate material and liquid. The exact nature of the surface treating media will, of course, depend upon the type of surface treatment to be carried out, and upon the material of which the workpieces 12 are fabricated. However, by way of example, the particulate material could be sand, stones, steel shot, and the liquid could be, for example, a solvent such as water.

FIG. 6 illustrates the apparatus 10 further including a hood structure 118 over the top of the housing 14 and cooperating with the housing walls 18, 20, 22 and 24 to define a low pressure chamber 120 over the top of the foraminous deck 26. As shown, the hood structure 118 includes two, parallel, spaced apart side walls 122 and 124 which are coextensive with and extend upwardly from the top edge of the housing side walls 18 and 20, respectively, and two, parallel, spaced apart end walls 126 and 128 which are spaced longitudinal of the housing inwardly of the housing end walls 22 and 24. The bottom ends of the hood end walls 126 and 128 are coplanar with the top ends of the housing side walls 18 and 20 to provide a workpiece entrance space beneath the bottom end of the upstream hood end wall 126 and a workpiece exit space beneath the bottom end of the downstream hood end wall 128. The hood structure 118 also includes a roof 130 which slopes upwardly from the hood walls 122, 124, 126 and 128 converging toward an apex. An exhaust duct opening 132 located at the apex of the hood structure 118 and is open to the low pressure chamber 120. Low pressure creating tans such as, for example, a suction fan or blower is operatively associated with the exhaust duct opening 132 through an appropriate duct (not shown) to remove air from the low pressure chamber 120 to create a low pressure with the chamber 120.

The operation of the apparatus 10 of FIGS. 1 and 2 are essentially identical. The air flow from the fluidizing gas plenum 28 flows upwardly through the foraminous deck 26 and through the bed of surface treating media 48 in the surface treating media reservoir 30, thus, fluidizing the treating media. The vibration imparted to the deck 26 imparts a vibratory motion scrubbing-like motion to the treating media, and the horizontal force component of the vibration force functions as a motive force to move the workpieces along the deck 26 through the bed of treating media from the upstream end of the deck 26 to the downstream end of the deck 26 whereupon the workpieces exit the surface treatment reservoir 30. The workpiece gradually becomes submerged in the bed of treating media as it moves downwardly along the declined section 32 of the foraminous deck 32, remains substantially submerged in the surface treating media as it moves along the horizontal section of the foraminous deck 26 and gradually emerges from the bed of surface treating media as it climbs the inclined section 35 of the foraminous deck.

Figure 3:
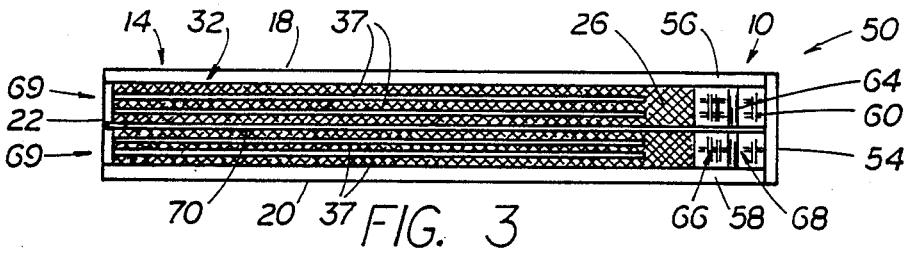
FIG. 3 is a top view of FIG. 1 as viewed in the direction of arrows 3—3 in FIG. 1.

With reference to FIG. 3, the suction fan causes the creation of a low pressure in the low pressure chamber 120 of the hood structure 118 which entrains lighter material cleaned from the workpieces to carry this material out of the apparatus 10, thus, preventing the treating media bed from becoming contaminated with a foreign material.

As the workpieces move along the horizontal section 34 of the foraminous deck 26, the clamping plate 84 is periodically moved downwardly to its lower oor workpiece clamping position shown in FIG. 2 to contact the top side of the workpieces moving on the horizontal section 34 and force the workpieces tightly against the horizontal section 34 to hold the workpieces stationary within the fluidized, agitating bed of surface treating material. By holding the workpieces stationary, they are exposed to the entire scrubbing action of the agitating surface treating media. After a selected period of time, the clamping plate 84 is raised to the workpiece release position shown in FIG. 1 disengaging from the workpiece thereby allowing the workpiece to resume movement along the foraminous deck 26.

As the workpieces have moved upwardly along the inclined section 35 of the foraminous deck 26, they exit the surface treating reservoir 30 and fall into the workpiece receiving enclosure 50. The workpiece receiving enclosure being attached to the housing 14, is also caused to vibrate. The vibration of the enclosure 50 causes the workpiece therein to also vibrate causing any residual surface treating media to be shaken from the workpiece. The residual surface treating media falls through the foraminous floor 60 of the enclosure 50 whereupon it can be collected.

If the workpiece is of a configuration which tends to trap surface treating material in, for example, interior workpiece cavities, it may be necessary to reposition the workpiece from its initial position in the enclosure 50 to make sure that all of the residual surface treating material is removed from the workpiece. Toward this end, the enclosure 50 is separated into the receiving sections 66 and 68 by the workpiece restraining means 64. A workpiece is initially received in the enclosure receiving section 66 from the treatment reservoir 30, and residual surface treating media is shaken loose as above discussed. The workpiece is then lifted out of the first enclosure receiving section 66 over the restraining means 64 and deposited in the other or second enclosure receiving section 68 in another orientation, for example, 180 degree from its initial orientation in the first receiving section 66. After the workpiece has been transferred from the first workpiece receiving section 66 to the second workpiece receiving section 68, another workpiece can be deposited in the first receiving section 66. Thus, two workpieces in different physical orientations can be received within the workpiece receiving enclosure at the same time without interruption to the flow of workpieces through the apparatus 10.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

We claim:

1. An apparatus for surface treating workpieces comprising:

a. means for defining a reservoir for containing a bed of surface treating media;

b. vibrating means for parting a vibrating force to the reservoir defining means;

c. means for passing a gas generally upwardly through the reservoir defining means to fluidize the bed of surface treating media contained therein; and d. means for clamping the workpieces in a stationary position in the reservoir defining means, the clamping means comprising a plate located over the reservoir defining means and being selectively movable between a workpiece clamping position whereat the plate contacts the workpieces to hold them in a stationary position securing the workpieces against the reservoir defining means in spaced relationship to each other and a release position whereat the plate is out of contact with the workpieces allowing the workpieces to be conveyed through the reservoir defining means.

2. The apparatus of claim 1, wherein the workpiece clamping means clamps the workpieces against the reservoir defining means.

3. The apparatus of claim 1, wherein the workpiece clamping means is adapted for clamping a plurality of workpieces at different locations in the reservoir defining means.

4. The apparatus of claim 1, comprising declined ramp means located in the reservoir along which the workpieces move as they enter the reservoir defining means.

5. The apparatus of claim 1, comprising inclined ramp means located in the reservoir along which the workpieces move as they exit the reservoir defining means.

6. The apparatus of claim 1, comprising workpiece receiving means located at one end of the reservoir defining means for receiving workpieces leaving the reservoir defining means.

7. The apparatus of claim 1 wherein the vibrating means imparts a vibrating force having at least a generally horizontal force vector to the reservoir defining means causing the unclamped workpieces to be conveyed through the reservoir defining means in the direction of the horizontal force vector.

8. The apparatus of claim 1, wherein the means for passing a gas generally upwardly through the reservoir defining means comprises:

a. means defining a fluidizing gas plenum below the reservoir defining means for receiving a pressurized gas; and b. means establishing gas flow communication from the gas plenum to the reservoir.

9. The apparatus of claim 1, further comprising:

a. means defining a low pressure gas chamber over the reservoir defining means for creating low pressure area within the low pressure gas chamber defining means over the reservoir

10. An apparatus for surface treating workpieces, comprising:

a. a housing having a floor, spaced apart end walls, and spaced apart side walls;

b. a foraminous deck located within the housing below the top edges of the housing walls and above the housing floor;

c. a surface treating media reservoir for containing a bed of surface treating media defined by the foraminous deck and portions of the housing walls above the foraminous deck;

d. vibrating means for imparting a vibratory force to the housing; and e. means for clamping the workpieces in a stationary position in the surface treating media reservoir securing the workpieces against the foraminous deck in spaced relationship to each other.

11. The apparatus of claim 10, wherein the clamping means comprises workpiece engaging means located over the top surface of the foraminous deck and movable in directions generally toward the foraminous deck to a workpiece clamping position, away from the foraminous deck to a workpiece release position.

12. The apparatus of claim 10, wherein the workpiece engaging means when in the clamping position, is adapted to contact the workpiece located in the reservoir and force the workpiece against the foraminous deck.

13. The apparatus of claim 10, wherein the workpiece engaging means comprises resilient workpiece engaging surface means.

14. The apparatus of claim 10, wherein the clamping means comprises a workpiece engaging surface which extends over a portion of the length of the housing between the housing end walls, and over a portion of the width of the housing between the housing side walls.

15. The apparatus of claim 10, wherein the workpiece engaging means is adapted to engage a plurality of workpieces in the surface treating media reservoir.

16. The apparatus of claim 15, wherein the workpiece engaging means is adapted to contact a plurality of workpieces located at different locations on the foraminous deck.

17. The apparatus of claim 16, wherein the workpiece engaging means is adapted to exert generally equal forces on each of the workpieces being clamped against the foraminous deck,

18. The apparatus of claim 10, further comprising:

a. declined ramp means located in the reservoir extending from the upstream end wall of the housing along which the workpieces move as they enter the surface treating media reservoir.

19. The apparatus of claim 10, further comprising inclined ramp means located in the reservoir extending to the downstream end wall of the housing along which the workpieces move as they exit the surface treating media reservoir.

20. The apparatus of claim 10, comprising workpiece receiving means located at one end of the surface treating media reservoir for receiving treated workpieces leaving the reservoir.

* * * * *